United States Patent [19]

Rice

[11] 4,455,806

[45] Jun. 26, 1984

[54] STRUCTURAL BUILDING MEMBER

[76] Inventor: Donald W. Rice, 2731 Sagamore Rd., Toledo, Ohio 43606

[21] Appl. No.: 325,134

[22] Filed: Nov. 27, 1981

Related U.S. Application Data

[63] Continuation of Ser. No. 914,887, Jun. 12, 1978.

[51] Int. Cl.[3] ..... E04C 3/30

[52] U.S. Cl. ..... 52/732; 52/727; 52/729

[58] Field of Search ..... 52/729, 732, 739, 630, 52/727, 403, 730, 370, 401, 480

[56] References Cited

U.S. PATENT DOCUMENTS

| | | | |
|---|---|---|---|
| 2,141,919 | 12/1938 | Kotrbaty | 52/729 X |
| 2,774,386 | 12/1956 | Formenti | 52/730 X |
| 3,333,390 | 8/1967 | Banning | 52/732 |
| 3,342,007 | 9/1967 | Merson | 52/729 |
| 3,517,474 | 6/1970 | Lanternier | 52/729 X |
| 3,609,933 | 10/1971 | Jahn et al. | 52/729 X |
| 3,824,664 | 7/1974 | Seeff | 52/630 X |
| 4,071,995 | 2/1978 | Farmer | 52/732 X |

*Primary Examiner*—Carl D. Friedman

[57] ABSTRACT

The invention relates to structural shapes intended to be used as joists, studs, braces, and/or connective members associated with frames, buildings, shipping containers, truck and trailer bodies, and other similar construction applications and, according to the invention, can preferably be roll formed from a coated metal strip to provide a novel laminated configuration which helps to reduce the rate of heat loss through a wall, roof, or floor in which they may be installed.

7 Claims, 11 Drawing Figures

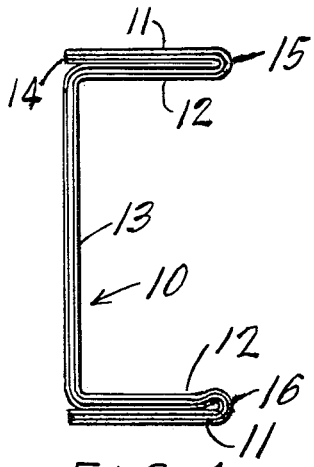
FIG. 1
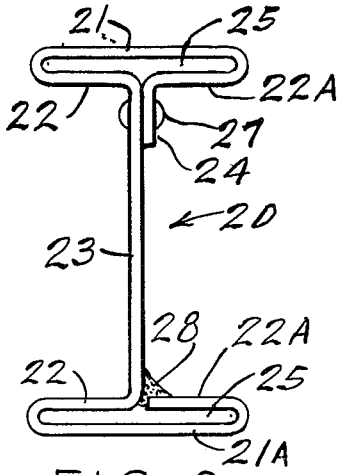
FIG. 2
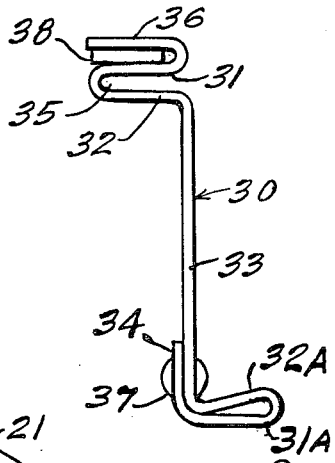
FIG. 3
FIG. 11
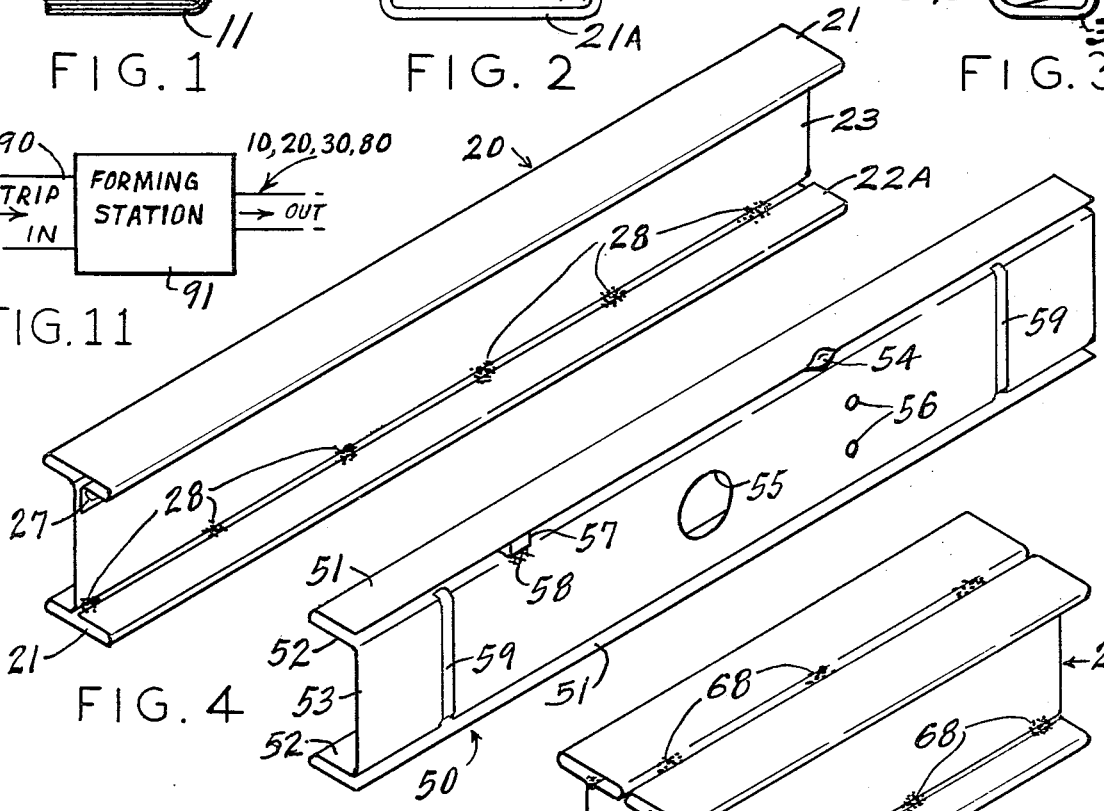
FIG. 4
FIG. 5
FIG. 6
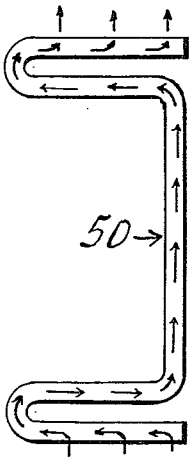
FIG. 8
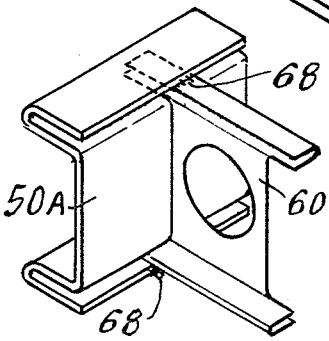
FIG. 9
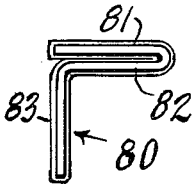
FIG. 10
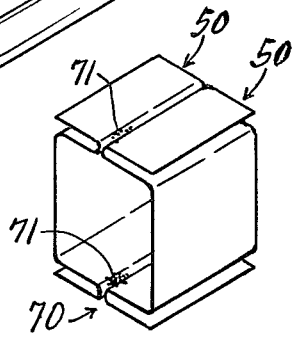
FIG. 7

STRUCTURAL BUILDING MEMBER

This application is a continuation of application Ser. No. 914,887, filed June 12, 1978.

It is an object of the present invention to provide a structural beam element having at least one multi laminar flange section adjoining a non laminar thinner web section for use with like or conventional I-beams, structural channels, and/or other convential building materials.

Another object of the invention is to reduce the heat carrying capacity of a structural member due to metal conductivety by further reducing the ratio of metal thickness in the web section versus the thickness of flange section and by increasing the distance of conductive heat travel through the member.

Still a further object of the invention is to provide lighter and therefore lower cost structural members which can be formed by lighter machinery.

Still additional objects, benefits, and advantages will become evident from a study of the following detailed description taken in conjunction with the accompanying drawing in which:

FIG. 1 is an end view of a structural channel member formed according to the invention.

FIG. 2 is an end view of a structural I-beam formed according to the invention.

FIG. 3 is an end view of a Zee shaped member formed according to the invention.

FIG. 4 is an isometric view of the I-beam shown in FIG. 2.

FIG. 5 is an isometric view of a channel member similar to that shown in FIG. 1.

FIG. 6 is an isometric view of an assembly of two I-beam members according to the invention and welded together to form a wider, longitudinally more stable beam.

FIG. 7 is an isometric view of a box beam fabricated by welding two channel members (FIG. 5) together.

FIG. 8 is a diagramatic view illustrating the basic heat flow transfer pattern through a channel section such as shown in FIG. 5.

FIG. 9 is an isometric view showing a short length of Zee section connected to a channel member.

FIG. 10 is an end view of an angle shaped member according to the invention.

FIG. 11 is a view illustrating flat strip moving through a rolling mill, or processing station to form the various shape requirements involved in the invention.

The invention embodies a structural beam member for use primarily as a joist or the like formed from a single strip of flat stock and having, at least one flange formed by bending back a section of the stock to overlay another section which extends at an angle from a web. The member has a longitudinal axis extending in the length direction of the member and a transverse axis extending perpendicular to the plane of the flange. The stock may be coated to reduce the transmission of heat through the flange. The flange is formed in sections and with a first section continuous with the web and bent at an angle with respect to the plane of the web. A second flange section is continuous with the first section and bent at an angle with respect to the first flange section to overlap the first section. The two overlapping flange sections may form a cavity, and may be spaced apart by detents. The air space in the cavity is insulative or may be filled with another insulative material. The sections may be bent parellel so that the aforesaid coating on the member fills the cavity.

Spacing members on the flange sections rather than the insulative coating could be used to prevent conductive contact of the flange portions and thus reduce the transmission of heat through the flange or as as stated above, the insulative material may space the flange sections and also serve to reduce heat transmission.

Referring now specifically to the drawings, differences between upper and lower flanges shown in some drawings are essentially for illustration purposes. Preferred construction utilizes identical upper and lower flanges in any of the members involved. It is further understood that all flange types shown would also have similar application to other beam types shown in other drawings.

FIG. 1 shows a channel member 10 having a web 13, a first flange with leaves 12, forming a first flange section and and overlaying flange leaves 11, forming a second flange section. A coating 14 separates said leaves in each respective flange to preclude metal contact as well as to provide protection for the base metal. Different bend radii 15 and 16 also shown.

Fig. 2 shows an I-beam member 20 with first and second flanges being in opposed spaced relationship and, having a web 23, primary leaves 22, forming first flange sections, secondary leaves 21 and 21A, forming second flange sections. Flange leaves 22A, forming second flange sections are attached to the web 23 by welding 28 or by riveting 27 through lip 24. Other methods of fastening such as bolting or spot welding through the lip would also be used as required. An air space 25 prohibits contact of the flange leaves.

FIG. 3 shows a Zee member 30 having a web 33, primary leaves 32, 32A and secondary leaves 31 and 31A, a tertiary leaf 36 at the top provides additional flange strength. Riveted (or otherwise fastened) lip 34 also reinforces web 33 at the flange connection area. Primary flange leaf 32A lies in overlaying proximity but not parallel to secondary flange 31. An insert 38 insulates and/or separates flange leaves 36 and 31A. Web section 33 could run diagonally as well as perpendicular to the flanges.

FIG. 4 is an isometric view of the I-beam member shown in FIG. 2. Continuous welding (not shown) as well as skip welding 28 could be used to attach the lower flange to the web 23.

FIG. 5 is an isometric view of a channel member 50 having a web 53, primary flange leaves 52, and secondary flange leaves 51. A spacer 57 is welded 58 in place or a detent 54 is used to seperate the flange leaves. Holes 55, 56, are located where required to facilitate incorporation of the member in a structure. Formed indentations 59 are used as web stiffeners and/or bend radius stiffeners when and where required.

FIG. 6 shows two I-beam members 20 welded together to form a double I-beam 60 assembly having additioanal longitudinal stability as well as other properties. Additional members similarly attached (not shown) would provide rigid plank-like decking for other applications.

FIG. 7. Box member 70 utilizes two channel members 50 welded together 71 to form a tubelike beam.

FIG. 8. Channel member 50 illustrates the elongated heat flow pattern characteristics of beams made according to the invention. It further illustrates the comparatively thin web section 53 with relation to the combined flange leaves 51 and 52.

FIG. 9 illustrates a bridging Zee member 60 welded 68 to channel member 50A and a similar member (not shown).

FIG. 10. An angle member 80 is shown to include a web 83, a primary leaf member 82 and a secondary leaf member 81.

FIG. 11 depicts steel strip 90 going through a forming station 91 and coming out as channel 10, I-beam 20, Zee member 30 or angle 80. Other forming means including brake forming would also be used to achieve desired configurations.

Various braces, accessories, reinforcements, and modifications will be suggested to the reader from the above description and it is understood that such modifications can be made without departing from the scope of the invention if within the spirit of depending claims.

I claim:

1. Amend to read as follows: A structural member formed from a unitary strip of substantially uniform thickness: said member having a flat web and a first flange: said first flange having a first section continuous with said web and with the first flange section forming an angle with said web: said first flange having a second section continuous with first section and overlapping said first section and including separately disposed spacing members spaced along the beam in contact with both flange sections in an unstressed condition of the beam to maintain said flange sections in a spaced apart relationship and wherein an insulating cavity is formed between said first and second sections of said first flange.

2. The structural member of claim 1 wherein said member has a longitudinal axis and a transverse axis, said transverse axis passing through said web and said flanges and said longitudinal axis extending along the web parallel to said flange, and said flat web portion includes a stiffening means to stiffen said member against a load applied in the direction of the transverse axis.

3. The member of claim 2 wherein the stiffening means is an integrally formed rib in said web.

4. The structural member of claim 3 where rib stiffening means extends partially into said flange.

5. The structural member of claim 1 wherein said member includes a second flange continuous with said web and in opposed relation to the said first flange, said second flange having a first section continuous with the web and forming an angle with the web, said second flange having a second section continuous with the said first section and overlapping the said first section of said second flange.

6. A structural beam member formed from a strip of flat stockhaving a flat web portion and at least one flange portion extending along and laterally away from said web portion, said strip including a coating of heat insulating material; said flange portion comprising a primary leaf portion adjacent said web and a secondary leaf portion folded back along the length of said primary leaf portion in laminar relationship therewith and coextensive with said web; said insulating material being in captive relation between said leaf portions whereby heat transmission through the flange is intercepted and reduced by said insulating material.

7. A structural beam member formed from a strip of flat stock having a flat web portion and at least one flange portion extending along and laterally away from said web portion, said strip including a coating of heat insulating material: said heat insulating material being bonded to said flat stock: said flange portion comprising a primary leaf portion adjacent said web and a secondary leaf portion folded back along the length of said primary leaf portion in opposed relationship therewith and coextensive with said web; said heat insulating coating material being in spaced apart relation between said leaf portions whereby heat transmission through the flange is intercepted and reduced by said insulating material.

* * * * *